United States Patent [19]

Theurer

[11] 3,972,292

[45] Aug. 3, 1976

[54] TRACK RENEWAL APPARATUS

[75] Inventor: Josef Theurer, Vienna, Austria

[73] Assignee: Franz Plasser Bahnbaumaschinen-Industrie-Gesellschaft m.b.H., Vienna, Austria

[22] Filed: Mar. 5, 1975

[21] Appl. No.: 555,703

[30] Foreign Application Priority Data

Mar. 11, 1974 Austria ..... 2020/74

[52] U.S. Cl. ..... 104/2

[51] Int. Cl.[2] ..... E01B 29/17

[58] Field of Search ..... 104/2, 4, 5, 6, 7 R, 104/8

[56] References Cited

UNITED STATES PATENTS

| | | | |
|---|---|---|---|
| 3,521,565 | 7/1970 | Plasser et al. | 104/2 X |
| 3,635,164 | 1/1972 | Patton | 104/2 X |
| 3,750,299 | 8/1973 | Plasser et al. | 104/7 R X |
| 3,795,056 | 3/1974 | Plasser et al. | 104/7 R X |

*Primary Examiner*—Frank E. Werner
*Assistant Examiner*—Randolph A. Reese
*Attorney, Agent, or Firm*—Kurt Kelman

[57] ABSTRACT

A mobile track renewal apparatus comprises a frame mounted on undercarriages for mobility on the replacement track in an operating direction during track renewal. Carrier arms extend forwardly and rearwardly from the mobile frame and respectively receive the new and old rails, the carrier arms being vertically and laterally adjustable in relation to the frame and fixable in a selected adjusted position. Similarly adjustable and fixable guides are mounted on the frame for guiding and laying the new rails.

2 Claims, 2 Drawing Figure

TRACK RENEWAL APPARATUS

Figure 1:
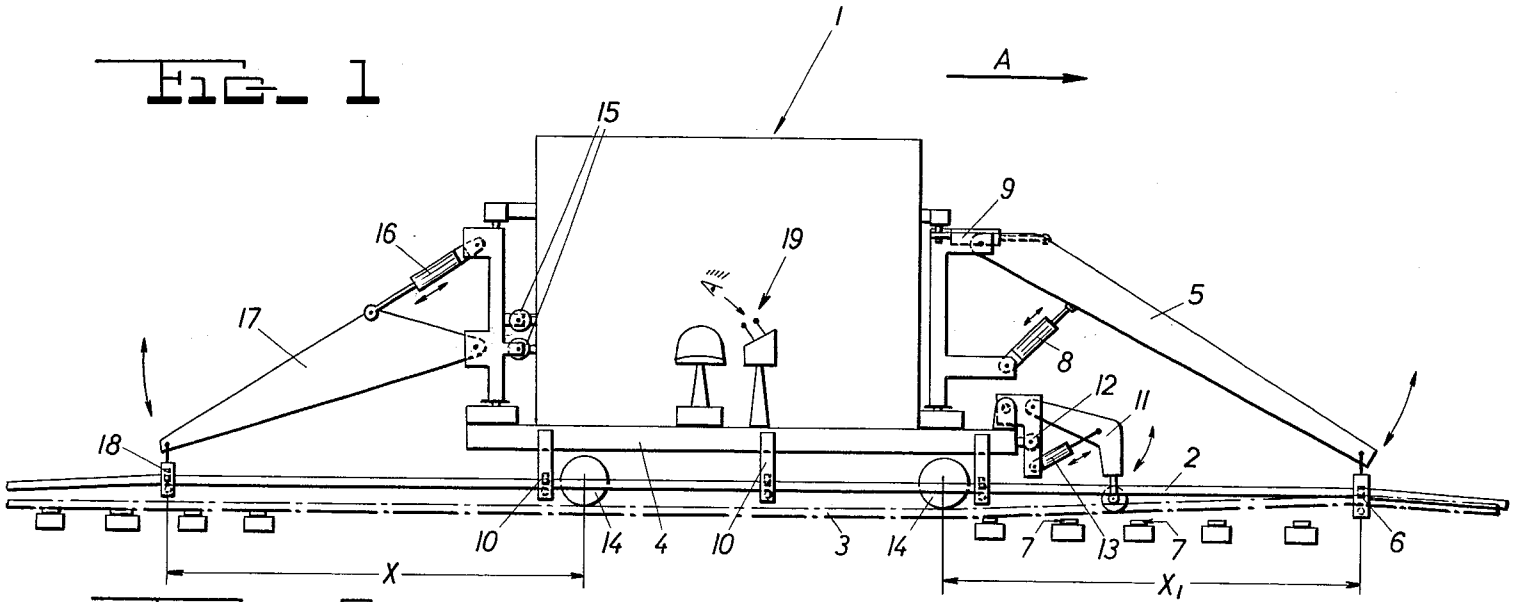

The present invention relates to improvements in a mobile track renewal apparatus for concurrently receiving an old rail of an existing track and laying a new rail of a replacement track.

Mobile track renewal apparatus has been described, for instance, in U.S. Pat. No. 3,330,219, dated July 11, 1967, U.S. Pat. No. 3,521,565, dated July 21, 1970, U.S. Pat. No. 3,685,456, dated Aug. 22, 1972, U.S. Pat. No. 3,604,358, dated Sept. 14, 1971, and U.S. Pat. No. 3,654,868, dated Apr. 11, 1972.

It will be understood that the term "new" rails refers only to the fact that they form part of a newly laid track designed to replace an old track and that sucb "new" rails in the replacement track may, in fact, be used rails.

This invention provides improvements in the type of mobile track renewal apparatus which comprises a frame mounted for mobility on the replacement track in an operating direction during track renewal and a carrier arm extending forwardly in the operating direction from the mobile frame. The carrier arm is adjustable vertically and laterally in relation to the replacement track and may be fixed in a selected adjusted position. Means laterally of the frame and carrier arm receive the old and new rails, these means being movable along the rails, and means are mounted on the frame for guiding and laying the new rail. The rail guiding and laying means are also adjustable vertically and laterally and may be fixed in a selected adjusted position.

Such an apparatus is designed for and capable of replacing at least one old rail of an existing track by a new rail of a replacement track while the apparatus frame advances continuously along the track, the new rails being stored in the center of the track while the old rails are laid on the outer ends of the track ties. During track renewal, the new rails stored in the track center and the old rails are concurrently lifted until the undersides of the rails are positioned above the rail fastening means, for instance the ribs of fish plates used for fastening the rails to the ties. The old rails are then spread apart a distance greater than the track gage, and the new rails are centered above the rail fastening means and then laid, for instance between the ribs of the fastening plates. The old rails may simply be placed on the outer ends of the ties for eventual removal or they may be placed in the center of the replacement track between the newly laid rails. As more fully described in any of the above-mentioned patents, for instance, it is thus possible to renew tracks in a single pass in a continuous manner.

In such an apparatus, the means mounted on the mobile frame and carrier arm for receiving the old and new rails comprise rollers mounted on the frame and carrier arm for guiding the rails. The means for guiding and laying the new rails comprise gripping roller arrangements for engaging the head of the new rail. Gripping roller arrangements are mounted alongside the apparatus for guiding the old rails along a path spread beyond the track gage and for placing the old rails on the outer ends of the ties. Since the old rails as well as the new rails are received and guided in the region of the forwardly extending carrier arm and immediately adjacent the rear end of the mobile frame and the rear undercarriage supporting the same on the track, the front and rear undercarriage of the machine frame are subjected to unequal loads.

It is the primary object of the invention to improve the guidance of the old rails in the region where they are placed on the ties during the track renewal operation.

It is a concomitant object to distribute the weight of the replaced old rails and the new rails equally over the two undercarriages or axles of the mobile machine frame during the renewal operation.

The above and other objects are accomplished in accordance with the present invention by providing a further carrier arm extending rearwardly in the operating direction from the mobile frame. The further carrier arm is also vertically and laterally adjustable and may be fixed in a selected adjusted position. Means are mounted on the further carrier arm for guiding and receiving the old rail.

According to a preferred feature of this invention, the distance between the rail receiving means on the forewardly extending carrier arm and a next adjacent undercarriage is substantially the same as the distance between the rail receiving means on the rearwardly extending carrier arm and a next adjacent undercarriage. This provides a very favorable weight equilibrium in a simple manner and symmetrically distributes the load over both axles of the mobile machine frame.

Figure 2:
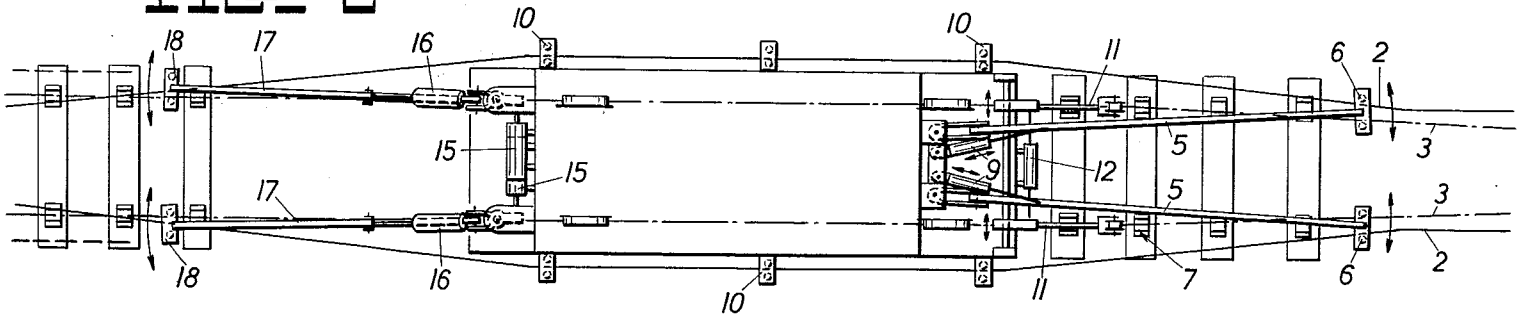

The above and other objects, advantages and features of the invention will become more apparent from the following detailed description of a now preferred embodiment thereof, taken in conjunction with the accompanying drawing wherein FIG. 1 is a schematic side elevational view of a track renewal apparatus according to the present invention and FIG. 2 is a plan view thereof, which also shows the positions of the old and new rails before and after replacement.

Referring now to the drawing, mobile track renewal apparatus 1 is designed for concurrently receiving old rails 2 of an existing track and laying new rails 3 of a replacement track as frame 1 moves on the replacement track in an operating direction indicated by arrow A during track renewal. The machine frame 4 is mounted for mobility on the track by front and rear undercarriages 14,14.

Two carrier arms 5,5 associated with a respective one of the rails extend forwardly from frame 4 in the operating direction and each carrier arm has mounted thereon a rail receiving means 6 for receiving and holding old rails 2 and new rails 3 stored on the track between the old rails. The rail receiving means guide the rails at a distance above the top side of the track ties which corresponds at least to the height of rail fastening means 7. In this manner, the old rails are lifted out of the fastening means and the new rails may be accurately centered above the fastening means. For this purpose, each carrier arm is vertically and laterally adjustable and fixable in a selected adjusted position. In the illustrated embodiment, this is accomplished by means of hydraulic drive 8 for vertical adjustment and hydraulic drive 9 for lateral adjustment of carrier arm 5. Each drive may be hydraulically locked in position to fix the carrier arm in the adjusted position.

A series of additional rail receiving means 10 are mounted on frame 4 for receiving, holding and guiding old rails 2 as the carrier continuously advances in the operating direction, these means spreading the old rails apart beyond the track gage and guiding the spread rails along the two sides of frame 4 towards the rear of the frame. All of the rail receiving means may comprise rail gripping rollers or gliding elements permitting relative movement between the rails and the rail receiving means in the operating direction.

Means 11 are mounted on frame 4 for guiding and laying new rails 3, the illustrated rail laying means for each new rail comprising a shorter carrier arm 11 supporting a suitable arrangement of rail gripping rollers or the like for guiding and placing the new rails on the rail fastening means. Each carrier arm 11 is vertically and laterally adjustable and may be fixed in a selected adjusted position. The lateral adjustment is effected in the illustrated embodiment by means of double-acting hydraulic drive 12, which could readily be replaced by two drives associated with a respective one of the carrier arms, for laterally adjusting the carrier arms in a plane parallel to the plane of the track and transversely to the track. In this manner, carrier arms 11 may be adjusted to the desired gage of the replacement track so that the new rails may be centered over the rail fastening means. The vertical adjustment of carrier arms 11 is effected in the illustrated embodiment by means of hydraulic drives 13 which permit the carrier arms to be raised and lowered in a vertical plane extending in the direction of the track so that the new rails may be placed on the fastening means after they have been centered thereover.

While the adjustment of the carrier arms 5 and 11 has been illustrated in connection with hydraulic drives which may be hydraulically locked in position, any suitable means, such as screw drives, cable drives and the like, with mechanical locking means, may be used.

As the above-described taking up of the old rails and laying of the new rails proceeds while the apparatus advances in the direction of arrow A, undercarriages 14,14 of frame 4 move on the replacement track constituted by newly laid rails 3,3. As is known in such track renewal operations, the new rails are fastened to the ties as or shortly after they have been laid.

According to the invention, old rails 2,2 are guided by roller arrangements 10 to rearwardly positioned rail receiving means 18,18 mounted on further carrier arms 17 to be stored between the newly laid rails (shown in full lines) or on the outer tie ends (shown in broken lines). Similarly to carrier arms 5,5, further carrier arms 17,17 are also vertically and laterally adjustable and may be fixed in a selected adjusted position. The lateral adjustment is effected in the illustrated embodiment by hydraulic drives 15 to enable each carrier arm 17 to be pivoted about a vertical axis transversely of the track. Vertical adjustment is effected by hydraulic drives 16 for pivoting the carrier arms in a vertical plane parallel to the track.

As will be noted from FIG. 1, operating console 19 is arranged centrally on mobile frame 4 to enable an operator to make the required adjustments of carrier arms 5 and 11 so as to guide and lay new rails 3 properly. Furthermore, it will be noted that the entire arrangement is substantially symmetrical in respect of the operating console, the distance $X_1$ between rails receiving means 6 and next adjacent undercarriage 14 being substantially the same as distance X between rail receiving means 18 and next adjacent undercarriage 14. This distributes the weight evenly and causes each undercarriage to be subjected substantially to the same load.

The illustrated arrangement makes it possible to store the old rails centered between the rails of the replacement track (full lines in FIG. 2) or outside the replacement track rails (broken lines in FIG. 2) without subjecting the rails to loads going beyond the limit of elasticity. Furthermore, the old rails may be positioned accurately for storing even in sharp curves. This is possible because of the adjustability of the rearwardly extending carrier arms in vertical and lateral directions. Also, the rearwardly extending carrier arms provided a counterweight on the mobile frame and stabilize the same without the provision of special counterweights.

The adjustment of the carrier arms may be effected by any suitable means, including electrical, pneumatic, hydraulic or mechanical drive and control means. The carrier arms themselves may take any suitable form and may be of any suitable structure. The specifically described embodiment is merely illustrative and does not limit the scope of this invention which is defined in the appended claims.

I claim:

1. In a mobile track renewal apparatus for concurrently receiving an old rail of an existing track and laying a new rail of a replacement track, which comprises a frame mounted for mobility on the replacement track in an operating direction during track renewal, a carrier arm extending forwardly in the operating direction from the mobile frame, the carrier arm being adjustable vertically and laterally and being fixable in a selected adjusted position, means laterally of the frame and carrier arm for receiving the old rail, the rail receiving means being mounted on the frame for movement along the rails, and means mounted on the frame for guiding and laying the new rail, the rail guiding and laying means being adjustable vertically and laterally and being fixable in a selected adjusted position: a further carrier arm extending rearwardly in the operating direction from the mobile frame, the further carrier arm being adjustable vertically and laterally and being fixable in a selected adjusted position, and means on the further carrier arm for receiving the old rail from the laterally mounted rail receiving means and for guiding the old rail.

2. In the mobile track renewal apparatus of claim 1, undercarriages supporting the frame for mobility on the replacement track, the distance between the rail receiving means on the forwardly extending carrier arm and a next adjacent one of the undercarriages being substantially the same as the distance between the rail receiving means on the rearwardly extending carrier arm and a next adjacent one of the undercarriages.

* * * * *